US010602896B2

(12) United States Patent
Isenberg et al.

(10) Patent No.: US 10,602,896 B2
(45) Date of Patent: Mar. 31, 2020

(54) SELF-PROPELLED CLEANING DEVICE

(71) Applicant: Vorwerk & Co. Interholding GmbH, Wuppertal (DE)

(72) Inventors: Gerhard Isenberg, Cologne (DE); Roman Ortmann, Duisburg (DE); Christian Holz, Dortmund (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 137 days.

(21) Appl. No.: 15/864,192

(22) Filed: Jan. 8, 2018

(65) Prior Publication Data

US 2018/0192837 A1 Jul. 12, 2018

(30) Foreign Application Priority Data

Jan. 9, 2017 (DE) ..... 10 2017 100 299

(51) Int. Cl.

| | |
|---|---|
| ***A47L 9/24*** | (2006.01) |
| ***A47L 11/40*** | (2006.01) |
| ***A47L 9/04*** | (2006.01) |
| ***A47L 5/12*** | (2006.01) |
| ***A47L 9/00*** | (2006.01) |
| ***A47L 9/28*** | (2006.01) |

(52) U.S. Cl.

CPC ..... *A47L 9/0483* (2013.01); *A47L 5/12* (2013.01); *A47L 9/00* (2013.01); *A47L 9/0477* (2013.01); *A47L 9/0488* (2013.01); *A47L 9/2805* (2013.01); *A47L 9/2847* (2013.01); *A47L 9/24* (2013.01); *A47L 9/28* (2013.01); *A47L 2201/00* (2013.01); *A47L 2201/04* (2013.01); *A47L 2201/06* (2013.01)

(58) Field of Classification Search

CPC ..... A47L 9/28; A47L 11/40; A47L 11/4038
See application file for complete search history.

(56) References Cited

U.S. PATENT DOCUMENTS

| | | | | |
|---|---|---|---|---|
| 2013/0067680 | A1 | 3/2013 | Yoshida | |
| 2016/0000288 | A1 | 1/2016 | Soejima | |
| 2017/0336798 | A1* | 11/2017 | Nam | A47L 5/22 |
| 2018/0192837 | A1 | 7/2018 | Isenberg et al. | |

FOREIGN PATENT DOCUMENTS

| | | | |
|---|---|---|---|
| DE | 10 2008 014 912 | A1 | 9/2009 |
| DE | 10 2009 049 637 | A1 | 4/2011 |

* cited by examiner

*Primary Examiner* — Michael D Jennings
(74) *Attorney, Agent, or Firm* — Collard & Roe, P.C.

(57) ABSTRACT

A self-propelled cleaning device has a surface cleaning system for cleaning a surface to be cleaned. In order to also be able to clean an above-floor surface, the cleaning device also has an above-floor cleaning element for mechanically cleaning an above-floor surface offset in terms of height relative to the surface. The above-floor cleaning element can be rotated and/or pivoted around a rotational axis, and at least one partial cleaning area of the above-floor cleaning element has a difference in height of roughly 3 cm or more relative to a lowermost standing surface of the cleaning device by comparison to a usual orientation of the cleaning device for a cleaning operation.

8 Claims, 6 Drawing Sheets

SELF-PROPELLED CLEANING DEVICE

CROSS REFERENCE TO RELATED APPLICATIONS

Applicant claims priority under 35 U.S.C. § 119 of German Application No. 10 2017 100 299.5 filed Jan. 9, 2017, the disclosure of which is incorporated by reference.

BACKGROUND OF THE INVENTION

1. Field of the Invention

The invention relates to a self-propelled cleaning device with a surface cleaning system for cleaning a surface to be cleaned.

In addition, the invention relates to a method for operating a self-propelled cleaning device, wherein the cleaning device cleans a surface to be cleaned by means of a surface cleaning system.

2. Description of the Related Art

Self-propelled cleaning devices of the aforementioned kind are known in prior art. In particular, these are cleaning robots that can perform a dry and/or wet cleaning job. During a cleaning operation, the cleaning device traverses the surface to be cleaned, and in the process removes dust or dirt from the surface to be cleaned, for example by means of a fan and/or any other cleaning elements that may be provided. The cleaning device here preferably navigates by means of a navigation and self-localization device within the environment, wherein distances from obstacles are measured to avoid a collision.

For example, publication DE 10 2008 014 912 A1 discloses a self-movable cleaning device with a distance meter for measuring the distance between the cleaning device and an object, for example an obstacle such as a wall or piece of furniture. The distance meter there has a triangulation system, for example, whose light source shines light onto the object to be measured and whose sensor detects light scattered or reflected by the object. The cleaning device thus receives information about the distance from the obstacle, so that a traversing strategy can be tailored thereto, and a collision with the latter is avoided in advance.

While being self-propelled, the cleaning device cleans the surface being traversed by the cleaning device. Cleaning takes place on the one hand by means of a vacuum generated by a fan, wherein dust and dirt are conveyed through a suction nozzle of the housing into a filter chamber of the cleaning device, and on the other hand usually while also interacting with a cleaning element, such as a bristle roller, which brushes over the surface to be cleaned, and in the process loosens up dust and dirt. Cleaning is here confined to the usually horizontally arranged surface on which the cleaning device moves. Subfloor surfaces are not cleaned.

Also known from 10 2009 049 637 A1 is a cleaning robot whose housing underside has secured to it a flexible cleaning wipe, whose edge area protruding over a guiding surface of the cleaning robot can be used for cleaning vertically arranged surfaces, for example baseboards. The edge area of the cleaning wipe arranged on the housing underside is tilted upward while approaching a corner, narrow section or baseboard, and there performs a cleaning action.

At best, the flexible, non-rigid design of the cleaning wipe makes it suitable to clean a lower area of a baseboard or an obstacle that faces the floor surface. Subfloor surfaces aligned essentially parallel to the floor surface can thus not be cleaned, since its low inherent rigidity causes the cleaning wipe to fold back toward the floor surface starting at a specific, slight difference in height.

SUMMARY OF THE INVENTION

Proceeding from the aforementioned prior art, the object of the invention is to provide a self-propelled cleaning device which, in addition to cleaning an essentially horizontal surface, in particular a floor surface, also makes it possible to clean a surface above the floor, for example the plateau of a baseboard.

In order to achieve the aforementioned object, the invention proposes that the cleaning device also have an above-floor cleaning element for mechanically cleaning an above-floor surface vertically offset relative to the surface, wherein the above-floor cleaning element can be rotated and/or pivoted around a rotational axis, and at least one partial cleaning area of the above-floor cleaning element has a difference in height of roughly 3 cm or more relative to a lowermost standing surface of the cleaning device by comparison to a usual orientation of the cleaning device for a cleaning operation.

According to the invention, in addition to the usual surface cleaning system for cleaning a surface on which the cleaning device usually moves, the cleaning device now also has an above-floor cleaning element, which can clean an above-floor surface arranged on a level higher than the surface on which the cleaning device is moving. In particular, this makes it possible to simultaneously de-dust a floor and clean an above-floor surface, such as a plateau of a baseboard. The proposed above-floor cleaning element moves relative to a housing of the cleaning device, specifically by rotating around a rotational axis or pivoting. A partial area of the above-floor cleaning element used for cleaning purposes is here arranged on the cleaning device in such a way as to intersect a height level spaced apart by 3 cm or more, for example by up to 8 cm, from a lowermost standing surface of the cleaning device. Within the meaning of the invention, the lowermost standing surface is here a contact area of the cleaning device that contacts the surface on which the cleaning device is located relative to the usual orientation of the cleaning device for a cleaning operation. This lowermost standing surface is usually a partial circumferential area of one or more traversing wheels of the cleaning device that touch the surface and/or a partial circumferential area of a cleaning element that contacts the surface. In other words, the cleaning partial area of the above-floor cleaning element is 3 cm or more, all the way up to 8 cm, for example, above a surface on which the cleaning device stands, so that above-floor cleaning can take place at a corresponding level of 3 cm to 8 cm above the surface, for example. However, the partial area to be cleaned can basically also have a height difference of more than 8 cm relative to the standing surface, for example 10 cm or 15 cm, in particular adjusted to especially high baseboards or other above-floor surfaces. A typical above-floor surface is the plateau of a baseboard, for example, which usually accumulates suction material and cannot be cleaned with self-propelled cleaning devices usual in prior art, since the latter fail to consider any measures for cleaning above-floor surfaces. The rotatable above-floor cleaning element advantageously rotates during above-floor cleaning, thereby yielding a cleaning function similar to that of a cleaning roller at a car wash facility. If the above-floor cleaning element cannot be rotated by 360 degrees or more, but rather can only pivot over an angular range, the above-floor cleaning element can pivot back and forth during an above-floor cleaning operation, wherein the above-floor surface is swept over like a windshield wiper. Depending on the vertical expansion of the above-floor cleaning element, not only can an above-floor surface here be cleaned, but so too can an accompanying lateral surface, for example, like a lateral surface of a baseboard. This further enhances the cleaning effect. With respect to the pivotable above-floor cleaning element, it can also be specially provided that the latter only be pivoted for an above-floor cleaning operation at the outset relative to a housing of the cleaning device, specifically toward the above-floor surface to be cleaned, and not move further around the rotational axis during the above-floor cleaning operation, but rather brush over the above-floor surface and potentially an accompanying lateral surface only by virtue of moving the cleaning device. The above-floor cleaning device can be rotated or pivoted around the rotational axis by means of a cleaning device motor, for example a motor that also drives the traversing wheels of the cleaning device and/or a cleaning element of the surface cleaning system, or a separate motor that serves exclusively to only move the above-floor cleaning element.

It is proposed that the above-floor cleaning element have a brush and/or a roller and/or a comb. In this sense, for example, a brush can be an essentially cylindrical element that has bristles pointing radially outward on its circumferential surface. The brush here has a plurality of bristles arranged one next to the other in rows and columns. In addition, the brush can also have a flat, unbent carrier element, on which a plurality of bristles are arranged in rows and columns. This brush can also rotate around the rotational axis, but here only engages with the above-floor surface or lateral surface when the bristles are currently in an angular range that intersects the above-floor surface or lateral surface. For example, an above-floor cleaning element having a roller can be a textile cleaning roller or a roller jacketed with a textile of the kind used in particular in wet cleaning devices. The textile can here be wetted with a liquid for an additional cleaning effect, so that a better dust adhesion can be achieved than with a dry textile when the roller contacts the above-floor surface or lateral surface. The roller can either be wetted manually by the user of the cleaning device or automatically by means of an applicator connected to the liquid container. In addition, the above-floor cleaning element can have a comb, for example which has linearly arranged bristle elements. Such a comb can either be rotated around the rotational axis or pivoted around a rotational axis, wherein only one angular range limited to the respective width of the bristles is in contact with the above-floor surface or lateral surface to be cleaned. Of course, above-floor cleaning elements that combine a brush, roller, comb and/or a plurality of the latter are also conceivable.

It is proposed that the rotational axis be arranged essentially perpendicular to the standing surface in relation to a usual orientation of the cleaning device for a cleaning operation. If the lowermost standing surface of the cleaning device stands on a surface, for example a floor surface, the rotational axis is perpendicular to this standing surface. As a result, the rotational axis is usually also perpendicular to the above-floor surface, e.g., so that the bristles of the above-floor cleaning element can brush over the above-floor surface along their longitudinal extension. Any lateral surface to be cleaned as well here preferably comes into contact with a partial circumferential area of the above-floor cleaning element. An essentially perpendicular arrangement of the rotational axis relative to the standing surface is also understood to include embodiments in which the rotational axis is slightly tilted, for example by plus/minus 10 degrees. A standing surface is here understood as a plane that is usually defined by several contact points or contact surfaces, and preferably has no rises or inclinations. Should the cleaning device nonetheless be located on a rising or inclined surface, for example, it goes without saying that the rotational axis of the above-floor cleaning element will then be correspondingly tilted.

As an alternative to an essentially perpendicular arrangement of the rotational axis to the standing surface, it can further be provided that the rotational axis be essentially aligned horizontally, so that the above-floor cleaning element is aligned parallel to a longitudinal extension of a plateau of a baseboard, and cleans the plateau like a horizontally arranged roller at a car wash facility.

It can further be provided that the above-floor cleaning element have bristles and/or filaments that have a free end area pointing downwardly from their fastening location on the rotational axis in relation to a usual orientation of the cleaning device for a cleaning operation. This embodiment is especially suitable for an above-floor cleaning element that rotates around a vertically arranged rotational axis. The bristles or filaments of the above-floor cleaning element are here not perpendicular to the rotational axis, but rather point downward, so that they extend downwardly away from a fastening location above a plane of the above-floor surface on the above-floor surface, and contact the above-floor surface at least with their free end areas. The bristles and/or filaments can here especially preferably be flexible in design and have an inherent rigidity, which causes the bristles or filaments to be lowered onto the above-floor surface as a result of the gravity acting on the bristles or filaments. Textile filaments are especially suitable, which form an above-floor cleaning element that resembles a conventional mop and hangs down on the above-floor surface. The filaments can be manually or automatically wetted with liquid, so as to achieve a better dust adhesion.

The above-floor cleaning element can advantageously be shifted toward a housing of the cleaning device and/or into a housing of the cleaning device, and/or shifted out of the housing. For example, the shifting of the above-floor cleaning element can take place exclusively outside of the housing of the cleaning device, or include shifting inside of the housing. In a case where the above-floor cleaning element can be shifted into the housing and can be shifted out of the housing, the above-floor cleaning element can especially advantageously be shifted into the housing when not in use, so that the outer shape of the cleaning device is advantageously reduced and the above-floor cleaning element does not cause the cleaning device to be spaced undesirably apart from an obstacle, a room boundary or the like, for example. If needed, i.e., if an above-floor cleaning operation is to take place, the above-floor cleaning element is correspondingly moved out of the housing again, making it available for an above-floor cleaning operation. Alternatively, the above-floor cleaning element can also be shifted only outside of the housing, specifically toward the housing and away from the housing. In particular, for example, an above-floor cleaning element can be folded against the housing of the cleaning device. In this conjunction, it can be provided that the above-floor cleaning element only shift relative to the housing when an above-floor cleaning mode of the cleaning device has been activated.

Also proposed in conjunction with the capability of shifting the above-floor cleaning element relative to the housing of the cleaning device is a regeneration element, which is arranged on the housing in such a way that the above-floor cleaning element brushes against the regeneration element while shifting relative to the housing. For example, the regeneration element can be a wiper lip, a brush or a comb. The proposed regeneration element serves to clean the above-floor cleaning element through a mechanical action. The regeneration element is here arranged in the shifting area of the above-floor cleaning element in such a way that the above-floor cleaning element brushes along the regeneration element as it shifts, and releases dust and/or dirt that had previously been picked up from the above-floor surface to the regeneration element. For example, the regeneration element can wipe off the bristles and/or filaments of a brush, a roller, a comb or the like, or remove dust and dirt from them in some other way. In particular, it can here be provided that the above-floor cleaning element be shifted relative to the housing of the cleaning device, and hence also relative to the regeneration element, at predetermined time intervals or at specific points in time solely for purposes of regeneration. The regeneration element can here preferably have a collecting vessel or the like allocated to it, so that the dust and/or dirt removed from the above-floor cleaning element does not make its way back to the above-floor surface or some other surface. In particular, a combination with a suction fan can also be advantageous, which transfers the loosened dust and/or dirt directly into a collecting tank. Alternatively, however, it can be provided that the dust and/or dirt be conveyed on the surface on which the cleaning device stands or moves, so that the cleaning device can pick up the dust and/or dirt by means of the usual surface cleaning system, for example by means of a suction fan of the cleaning device.

It is proposed that the above-floor cleaning element can be shifted relative to a housing of the cleaning device while changing the height difference. This embodiment makes it possible to adjust the above-floor cleaning element to a varying height of an above-floor surface or various heights of several above-floor surfaces. For example, the above-floor cleaning element can be shifted by pivoting and/or sliding the above-floor cleaning element relative to the housing. Shifting can be done manually by a user of the cleaning device or automatically by means of a motor control unit, which in particular is coupled to a height detector. It can also be provided that the above-floor cleaning element only shift relative to the housing when an above-floor cleaning mode of the cleaning device has been activated.

It can be provided that the rotational axis have allocated to it a spring element, which is arranged on the cleaning device and designed in such a way that a restoring force of the spring element acts in a direction away from a housing of the cleaning device, and/or that the spring element can be locked in a tensioned position through exposure to a force opposite the restoring force. For example, the above-floor cleaning element in this embodiment is tensioned by a spring force, and can be shifted relative to the housing of the cleaning device by releasing this tensioning, in particular removed from the housing into a position suitable for above-floor cleaning. In order to shift back the above-floor cleaning element and thus also the spring element, the above-floor cleaning element can again be shifted into the original position (resting position) through exposure to a predefined force, for example via a defined travel by the cleaning device against an object, a wall, a partial area of a base station provided for this purpose and the like. Alternatively, the spring element can also be tensioned opposite the restoring force and locked in this position via an electrical, mechatronic, mechanical or pneumatic drive, for example a servomotor, gearing, piezo element, shape memory alloy, etc. If at all possible, the above-floor cleaning element should again shift back once the above-floor cleaning operation has ended to avoid potential impacts with obstacles.

It is preferably proposed that the cleaning device have a control system, which controls a shifting and/or rotation of the above-floor cleaning element relative to a housing of the cleaning device as a function of a detection signal of a detection system, wherein the detection system is set up to detect an above-floor surface. In this embodiment, the above-floor cleaning element shifts and/or rotates automatically as a result of the signal of a detection system, which can detect an above-floor surface and in particular also determine its height. For example, the detection system can have a contact sensor that detects a collision associated with the presence of an above-floor surface. Alternatively and/or additionally, the detection system can have a detection system for a navigation system of the cleaning device, which detects the environment of the cleaning device, so that impacts can be prevented, and the cleaning device can move independently within the environment. For example, the detection system can be a triangulation measuring system, which can detect distances from objects, for example also baseboards with an above-floor surface. The detection system can likewise have an ultrasound sensor, infrared sensor, induction sensor or the like. All detection systems share in common that a height or height range of an above-floor surface can be determined by measuring at different height levels, so that the control system can infer the existence of an above-floor surface, and correspondingly initiate a shifting and/or rotation of the above-floor cleaning element for cleaning the above-floor surface.

It can be provided that the detection system have two distance sensors, which in relation to a usual orientation of the cleaning device for a cleaning operation have detection ranges that are vertically offset to each other and overlap in a vertical direction relative to a projection. The two distance sensors are arranged on the housing in such a way as to enable the detection of an above-floor surface, for example a plateau of a baseboard. The sensors contain a combination of two or more sensor elements, for example ultrasound sensors, infrared sensors, laser distance sensors or others, of which at least one determines a value for distance from an object having an above-floor surface, in particular a baseboard. Accordingly, at least one additional distance sensor measures a distance at another height, so that a shape or height of the object can be inferred from a difference between the measured distances and the respective height, enabling in particular a determination of whether an above-floor surface like a baseboard is involved. In particular, the detection system can also have more than two distance sensors, for example a sensor array with a plurality of sensors, which relative to a usual orientation of the cleaning device during a cleaning operation are arranged vertically one above the other. The sensors in this sensor array measure a plurality of measuring values at varying distances from a floor surface, so that a contour of an object can be scanned, an actual height, for example the height of the baseboard, can be detected, and a height adjustment of the above-floor cleaning device can be correspondingly initiated. In particular, it can here be provided that one or more distance sensors of the detection system simultaneously be sensors that are present on the cleaning device anyway according to prior art, for example a measuring system, in particular a triangulation measuring system, for navigating and self-localizing the cleaning device or the like. When using the laser distance sensor present for navigating on an underside of the housing of the cleaning device, the distance from obstacles advantageously be measured at an angle of 360 degrees.

In particular, it is proposed that a first distance sensor have a detection range with a distance of less than roughly 3 cm from a lowermost standing surface of the cleaning device at least in a partial area in relation to a vertical direction in space, and that a second distance sensor have a detection range with a distance of greater than roughly 8 cm from the lowermost standing surface in relation to the vertical direction in space. As a result of this embodiment, the distance sensors are positioned in such a way that at least one distance sensor has a detection range that encompasses a baseboard, and a second distance sensor has a detection range with no baseboard in relation to the same direction in space. The first distance sensor here determines a distance from an object, e.g., the baseboard in this case, while the second distance sensor, which potentially performs other tasks, such as navigating the cleaning device, can only be drawn upon if it has been determined that the cleaning device has approached the edge of a space. The distance between the second distance sensor and a floor surface is here dimensioned in such a way that its detection range lies above the detection range of the first distance sensor and above the upper edge of a conventional baseboard. The difference between the distance values measured by the two distance sensors makes it possible to infer the presence of a baseboard. For example, the detection ranges of the distance sensors can here be measuring planes of a sensor, which essentially lie horizontal and parallel to a planar floor surface during a cleaning operation given a usual orientation of the cleaning device. Deviations might here arise if the floor surface is an uneven surface and/or a floor surface with elevations or inclinations.

In addition to the self-propelled cleaning device described above, the invention also proposes a method for operating a self-propelled cleaning device, wherein the cleaning device cleans a surface to be cleaned by means of a surface cleaning system, and wherein the cleaning device mechanically cleans an above-floor surface that is displaced in height relative to the surface by means of an above-floor cleaning element, while it stands on the surface or moves on the surface, just as for a cleaning operation by means of the surface cleaning system, wherein the above-floor cleaning element for an above-floor cleaning operation is shifted in a direction away from a housing of the cleaning device after a restoring force exerted by a spring element allocated to the above-floor cleaning element, and wherein the above-floor cleaning element is shifted toward the housing when exposed to a predefined force opposite the restoring force, and there locked in a tensioned resting position. This procedure according to the invention serves to shift the above-floor cleaning element relative to the housing, so that an above-floor cleaning operation can be performed. In particular, the shifting can involve pivoting the above-floor cleaning element relative to the housing of the cleaning device or moving the above-floor cleaning element out of the housing of the cleaning device. The process of pivoting or moving out is here supported by the restoring force of the spring element, so that only a locking mechanism has to be released to transfer the above-floor cleaning element into an above-floor cleaning position. For example, this can be done by activating a button, switch or the like. In order to advantageously move the above-floor cleaning element back to or into the housing of the cleaning device after the above-floor cleaning operation has ended, the restoring force of the spring element must be overcome. This can be done either manually by a user or automatically, for example by the cleaning device moving against an obstacle, a partial area of a base station provided for this purpose or the like, as a result of which a defined force is applied to the spring element, which overcomes the restoring force and correspondingly causes the above-floor cleaning element to shift back and then be locked in the tensioned resting position.

In particular in conjunction with the method proposed above, it is also proposed that the cleaning device clean a surface to be cleaned by means of a surface cleaning system, wherein the cleaning device mechanically cleans an above-floor surface offset in terms of height relative to the surface by means of an above-floor cleaning element, while it stands on the surface or moves on the surface, as during a cleaning operation by means of the surface cleaning system, wherein the above-floor cleaning element is regenerated at a later point in time by means of a regeneration element of the cleaning device by having the above-floor cleaning element brush against the regeneration element while shifting relative to a housing of the cleaning device. This procedure serves to regenerate the above-floor cleaning element after having picked up dust and/or dirt during an above-floor cleaning operation. For example, in order to preserve the cleaning capability of the above-floor cleaning element, a regeneration can be performed by means of the regeneration element at prescribed time intervals or at specific points in time or even individually as desired by a user of the cleaning device. During regeneration, the regeneration element mechanically acts on the above-floor cleaning element by virtue of the above-floor cleaning element brushing against the regeneration element. For example, the regeneration element can advantageously be designed as a wiper lip, brush or comb, which strengthens the mechanical interaction between both elements. Alternatively or additionally, it can be provided that the above-floor cleaning element be rotated, so as to spin off dust and/or dirt from the surface of the above-floor cleaning element through centrifugal force. The above-floor cleaning element can also be vacuumed with streaming air. The above-floor cleaning element is especially preferably moved into the housing of the cleaning device in certain intervals, as a result of which the bristles and/or filaments, in particular textile filaments, of the above-floor cleaning element are combed by a comb-like regeneration element and freed of dust and/or dirt. This procedural step can be performed at a defined distance from an above-floor surface, so that the loosened dust and/or dirt cannot get back onto the above-floor surface. The dirt or dust removed from the above-floor cleaning element preferably gets onto a surface traversed by the cleaning device, so that the cleaning device can vacuum it up during a usual cleaning operation by means of a surface cleaning system and convey it into a dust chamber.

Even though the cleaning device according to the invention and the method for the latter are suitable in particular as relates to robotic vacuums, the cleaning device can also be a device designed exclusively as a wet cleaning robot. In addition, combinations are also conceivable, for example combined vacuum-wiping devices. Furthermore, the mechanically acting above-floor cleaning element can also be enhanced by a vacuum and/or fan system, which vacuums or blows suction material off of an above-floor surface.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
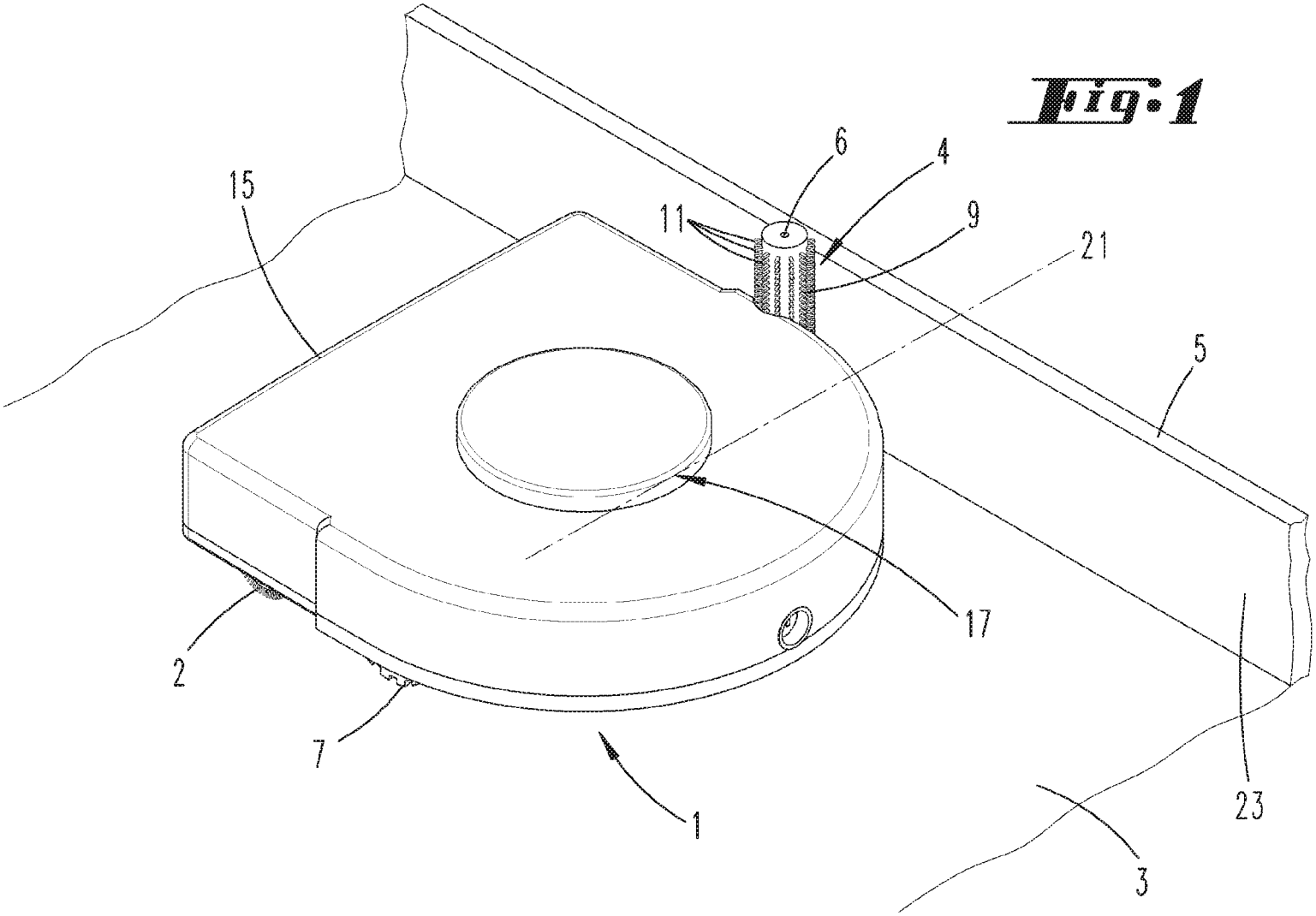
FIG. 1 is a perspective view of first embodiment of a cleaning device according to the invention.
Figure 2:
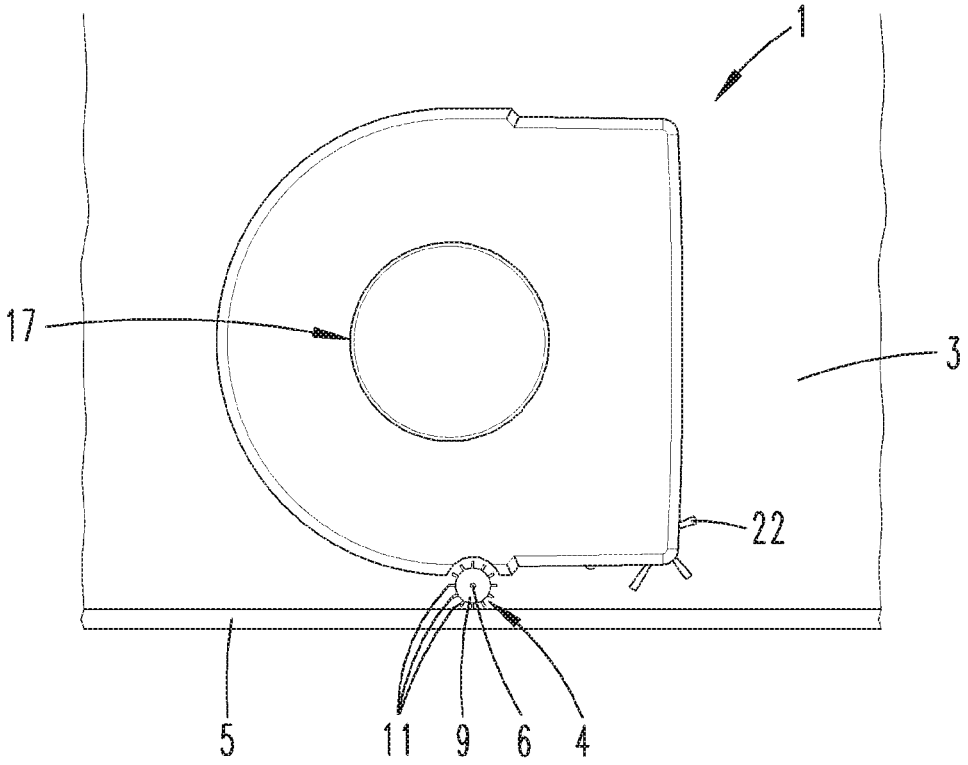
FIG. 2 is a top view of the cleaning device according to FIG. 1.
Figure 3:
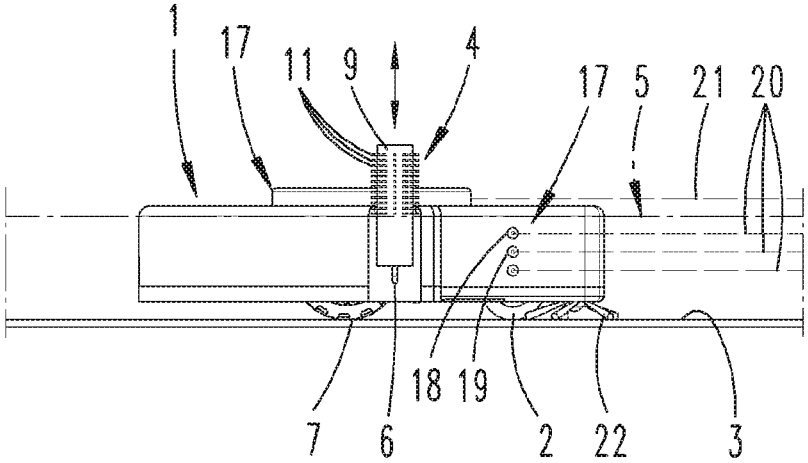
FIG. 3 is a side view of the cleaning device according to FIGS. 1 and 2.

FIGS. 1 to 3 show a cleaning device 1 according to a first embodiment. For example, the cleaning device 1 is here designed as an autonomous robotic vacuum. The cleaning device 1 has a housing 15, a surface cleaning device 2 and traversing wheels, which provide a standing surface 7 that contacts a partial area of a surface 3. The surface cleaning system 2 has a bristle roller and a motor-fan unit (not shown). An above-floor cleaning element 4 is laterally arranged on the housing 15 relative to a usual forward traveling direction of the cleaning device 1, and serves to clean an above-floor surface 5. For example, the above-floor surface 5 is here a plateau of a baseboard. The baseboard further has a lateral surface 23, which rises perpendicularly from the surface 3.

The above-floor cleaning element 4 is here designed as a cylindrical roller 9, which has a plurality of bristles 11 that point radially outward. The above-floor cleaning element 4 is mounted on a rotational axis 6 and can rotate around the latter. The rotational axis 6 of the roller 9 stands perpendicular to the surface 3, and thus also perpendicular to the standing surfaces 7 of the cleaning device 1. The above-floor cleaning element 4 is arranged on the housing 15 of the cleaning device 1 in such a way that at least a portion of the bristles 11 of the roller 9 is located above the above-floor surface 5, i.e., has a height difference relative to the lowermost standing surface 7 of the cleaning device 1 that is equal to or greater than the distance between the standing surface 7 and above-floor surface 5. For example, the height of the above-floor surface 5 relative to the surface 3 here measures 5 cm. Given the depicted orientation of the cleaning device 1 relative to the surface 3, the above-floor cleaning element 4 is located in a height range of between roughly 3 cm and 6 cm relative to the bristles 11 that initiate the above-floor cleaning operation, thus making it possible to clean the lateral surface 23 on the one hand and the above-floor surface 5 on the other.

As evident from FIGS. 2 and 3, the cleaning device 1 also has a lateral brush 22, which serves in particular to clean transitional areas between the horizontal and vertical surfaces, for example between the surface 3 and lateral surface 23.

The cleaning device 1 further has a detection system 17, which here has a triangulation measuring system, among other things. The triangulation measuring system usually serves to measure distances to objects so as to generate a map of an environment of the cleaning device 1, and thereupon enable a navigation and self-localization of the cleaning device 1 within the environment. The triangulation measuring system measures distances within a surface-shaped detection area 21, which here lies above the plane of the above-floor surface 5. As a consequence, the triangulation measuring system in the case depicted here cannot measure the distance from the baseboard, but can do so for a wall lying behind the latter, for example.

As evident from FIG. 3, the cleaning device 1 further has several distance sensors 18, 19, which are arranged vertically one above the other relative to the depicted orientation of the cleaning device 1. For example, these distance sensors 18, 19 are here ultrasound sensors, which can also measure a distance from objects. Each distance sensor 18, 19 also has a detection range 20 lying under the respective detection range 21 of the triangulation measuring system. Located here are the detection ranges 20 of all distance sensors 18, 19 at a height level under the plane of the above-floor surface 5.

A procedure for the depicted cleaning device 1 can now be carried out in such a way that the cleaning device 1 initially cleans the surface 3 by means of the surface cleaning system 2. The surface cleaning system 2 here acts on the cleaning surface 3, and vacuums suction material from the surface 3 into a dust chamber of the cleaning device 1. While moving over the surface 3, the detection system 17 of the cleaning device 1 continuously measures distances from obstacles within the environment, to include among other things from the lateral surface 23 and, for example, a wall arranged behind it (not shown). Since the triangulation measuring system of the detection system 17 measures within a detection range 21 arranged above the detection ranges 20 of the distance sensors 18, 19 designed as ultrasound sensors in relation to a height relative to the surface 3, the resultant values for distance from the next obstacle vary. The triangulation measuring system here measures a distance from the wall above the above-floor surface 5, while the distance sensors 18, 19 in relation to the same measuring direction measure a distance from the lateral surface 23 of the baseboard that intersects the detection ranges 20 of the distance sensors 18, 19. The measured distance values of the detection system 17 are relayed to an evaluation and control system of the cleaning device 1, which makes it possible to infer the existence of an above-floor surface 5 between the detection range 20 of the vertically uppermost distance sensor 18 and the detection range 21 of the triangulation measuring system based on the present distance difference and knowledge about the heights of the detection ranges 20, 21.

In order to now clean the above-floor surface 5, the cleaning device 1 travels toward the baseboard and orients itself relative thereto in such a way that the side of the housing 15 of the cleaning device 1 having the above-floor cleaning element 4 points to the lateral surface 23 of the baseboard. If the bristles 11 of the above-floor cleaning element 4 are not yet at a height suitable for cleaning the above-floor surface 5, the evaluation and control system of the above-floor cleaning element 4 or the rotational axis 6 can still shift accordingly, so that at least a partial cleaning area of the above-floor cleaning element 4 is arranged above the above-floor surface 5. In addition, the above-floor cleaning element 4 can be moved relative the housing 15 of the cleaning device 1 toward the lateral surface 23 or above-floor surface 5. This can take place automatically or be done manually by a user of the cleaning device 1. For example, the above-floor cleaning element 4 is shifted by relieving a spring element tensioned opposite its restoring force with a keystroke, so that the above-floor cleaning element 4 is resultantly shifted. The above-floor cleaning element 4 is applied to the lateral surface 23 in such a way that at least a portion of the bristles 11 protrudes over the above-floor surface 5. In order to clean the above-floor surface 5 as well as the lateral surface 23, the above-floor cleaning element 4 is rotated around the rotational axis 6. This is done by means of a motor of the cleaning device 1. The rotation brushes down dust and dirt from the above-floor surface 5 on the one hand, and from the lateral surface 23 on the other, so that gravity causes the latter to drop onto the surface 3, on which the cleaning device 1 is standing or travels along the lateral surface 23. This dust and/or dirt can then be transferred into a dust chamber of the cleaning device 1 by means of the surface cleaning system 2 of the cleaning device.

For example, after the above-floor surface 5 and lateral surface 23 have been cleaned, the cleaning device 1 can travel to a base station (not shown) and there press the above-floor cleaning element 4 against a surface provided for this purpose, whereupon the spring element of the above-floor cleaning element 4 is again shifted against its restoring force into a resting position and locked into it.

Since the above-floor surface 5 can basically lie even higher than an overall height of the cleaning device 1, the above-floor cleaning element 4 can basically be shifted in such a way as to be placed higher than the overall height of the cleaning device 1, so that the above-floor cleaning element 4 would resultantly also project into the detection ranges 20, 21 of the detection system 17. In this case, information could be sent to the control system of the cleaning device 1 during an above-floor cleaning operation in such a way as to mask out or not consider a corresponding angular range for navigating the cleaning device 1.

Figure 4:
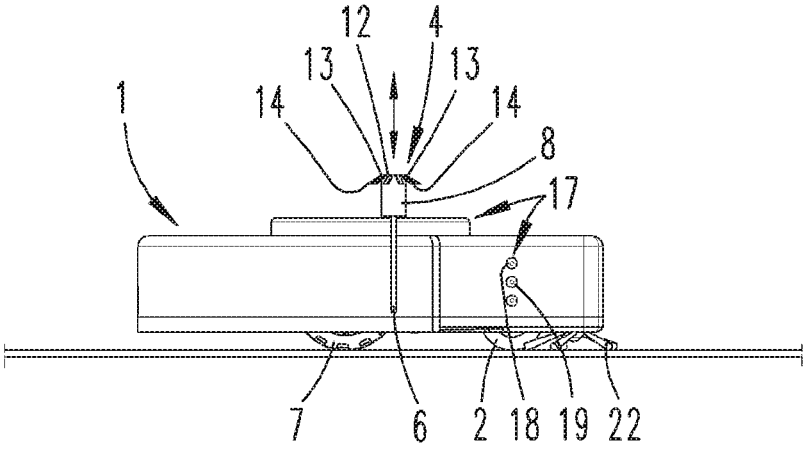
FIG. 4 is a side view of a second embodiment of a cleaning device.
Figure 5:
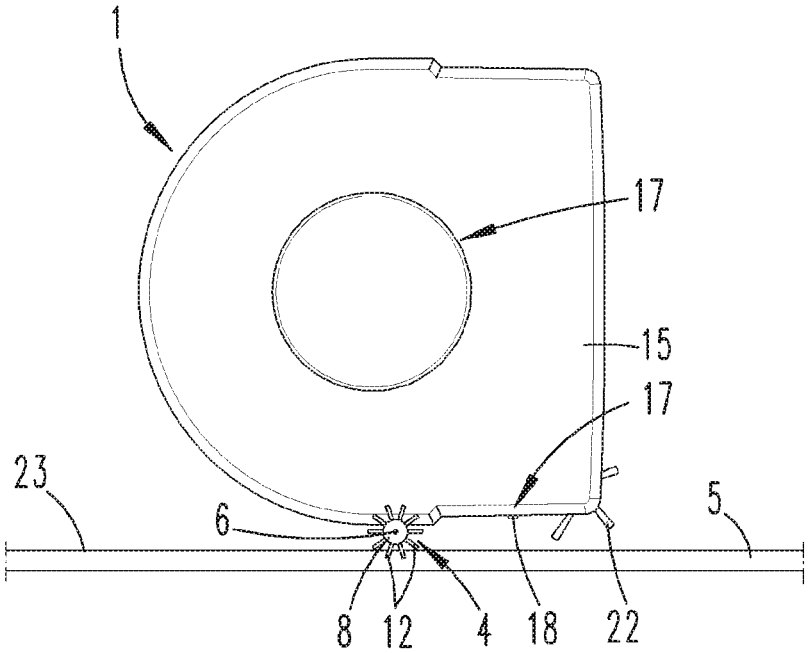
FIG. 5 is a top view of the cleaning device according to FIG. 4.

FIGS. 4 and 5 show a second embodiment of a cleaning device 1, in which the above-floor cleaning element 4 is a body that can also rotate around a vertical rotational axis 6. This above-floor cleaning element 4 is designed as a brush 8 with a plurality of textile filaments 12, which each are anchored on a fastening location 13 in the brush 8, and the force of gravity causes their opposing free end areas 14 to hang down.

The brush 8 rotates while an above-floor surface 5 is being cleaned, so that the filaments 12 are lifted in response to the centrifugal force, and brush over the above-floor surface 5. In addition, a wetting system (not shown) can be allocated to the above-floor cleaning element 4, and ensures that the filaments 12 are wetted. Alternatively, the filaments 12 can also be manually wetted by a user.

Otherwise, the procedure for this cleaning device 1 can take place analogously to the exemplary embodiment described above, i.e., the above-floor cleaning element 4 can also be shifted relative to the housing 15 of the cleaning device 1, and the above-floor surface 5 can be detected by means of the detection system 17.

Figure 6:
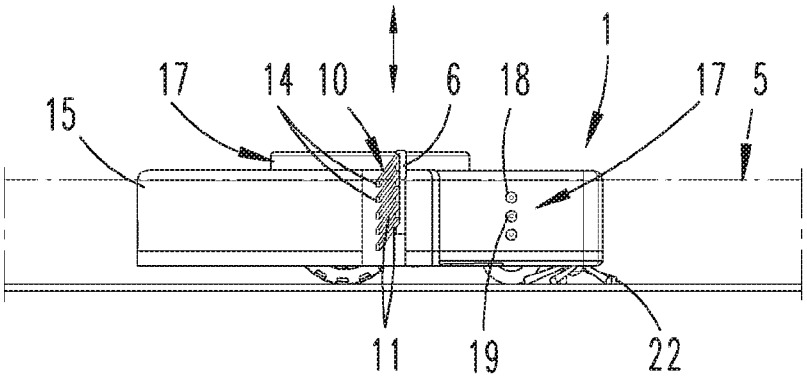
FIG. 6 is a side view of a third embodiment of a cleaning device.
Figure 7:
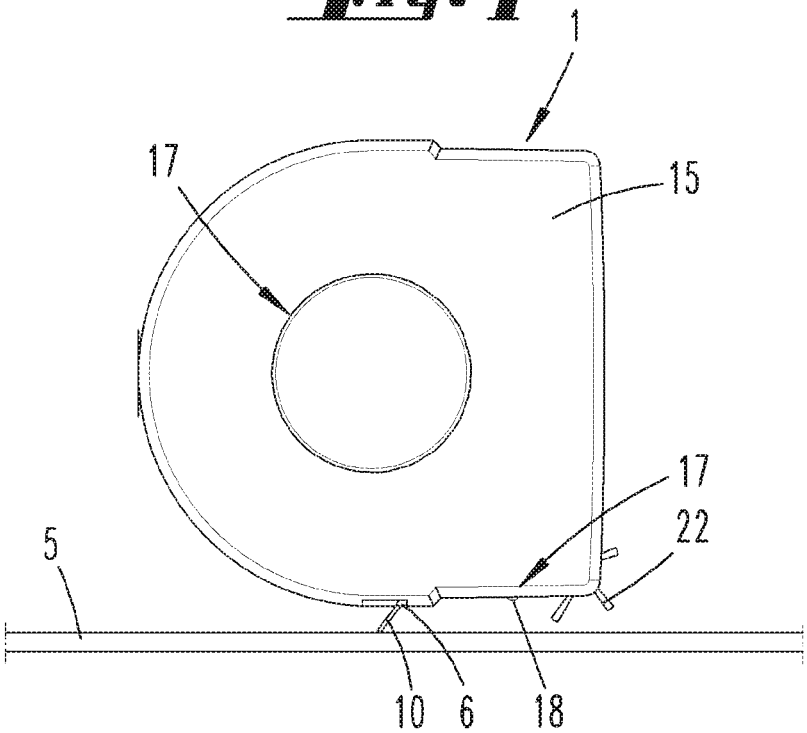
FIG. 7 is a top view of the cleaning device according to FIG. 6 with an extended above-floor cleaning element.
Figure 8:
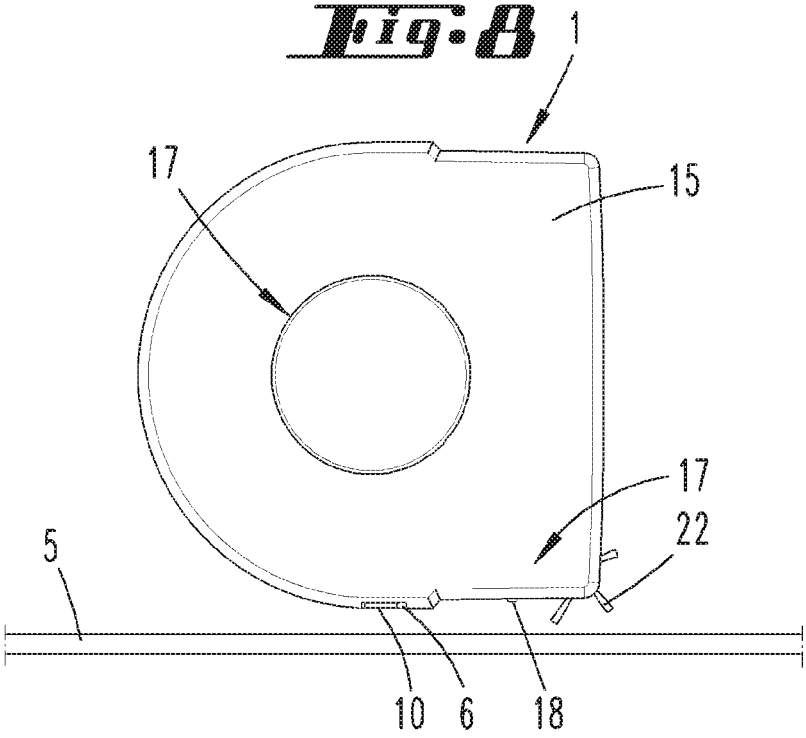
FIG. 8 is the cleaning device according to FIG. 7 with a retracted above-floor cleaning element.

FIGS. 6 to 8 show a third embodiment of the invention, in which the above-floor cleaning element 4 has a comb 10 with bristles 11 arranged vertically one over the other. The comb 10 can be pivoted relative to the housing 15 around a rotational axis 6. The comb 10 can here be shifted from a resting position pivoted into the housing 15 into an above-floor cleaning position pivoted out of the housing 15. Shifting preferably takes place automatically upon detection of an above-floor surface 5. FIG. 8 shows the above-floor cleaning element 4 in a state pivoted positively into the housing 15.

Figure 9:
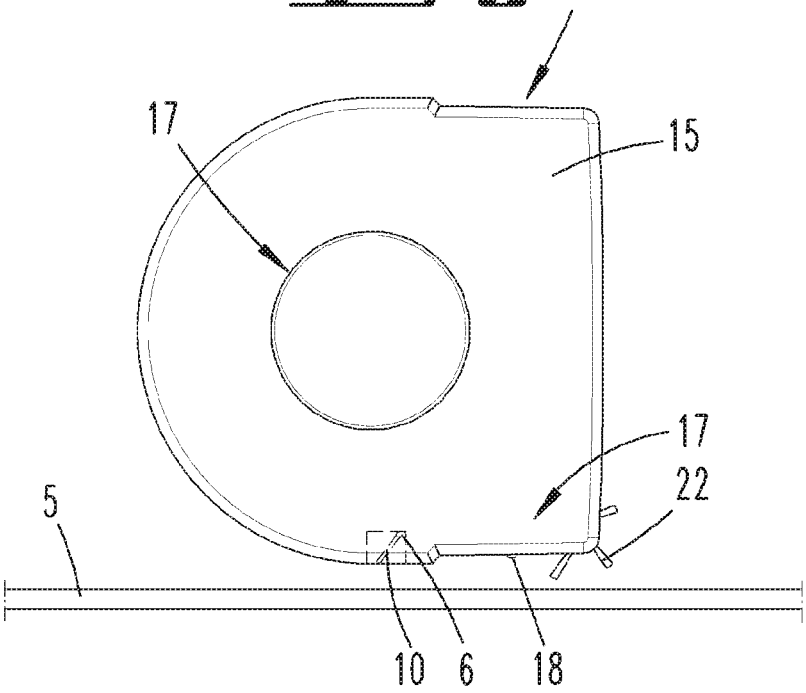
FIG. 9 is a top view of an alternative cleaning element with the above-floor cleaning element inserted into the cleaning device.

FIG. 9 presents an alternative embodiment thereto, in which the above-floor cleaning element 4 can be shifted proceeding from the described resting position linearly out of the housing 15, so as to perform an above-floor cleaning operation. For example, the above-floor cleaning element 4 designed as a comb 10 can be pivoted around the rotational axis 6 while cleaning an above-floor surface 5, for example in a back-and-forth movement over an angular range of 90 degrees, wherein the free end areas 14 of the bristles 11 brush over a lateral surface 23 and an above-floor surface 5.

Figure 10:
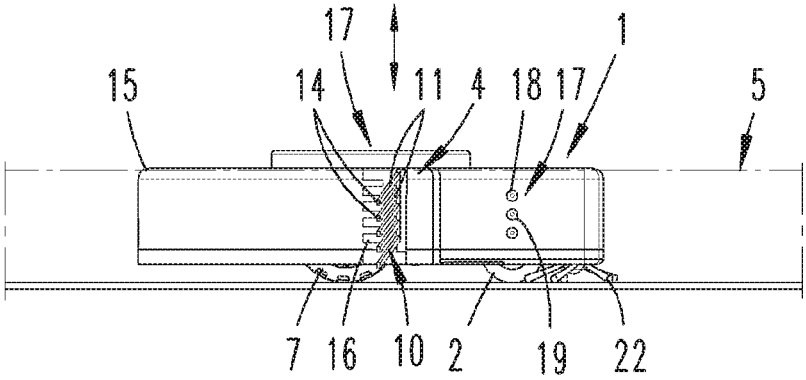
FIG. 10 is a side view of another embodiment of a cleaning device.
Figure 11:
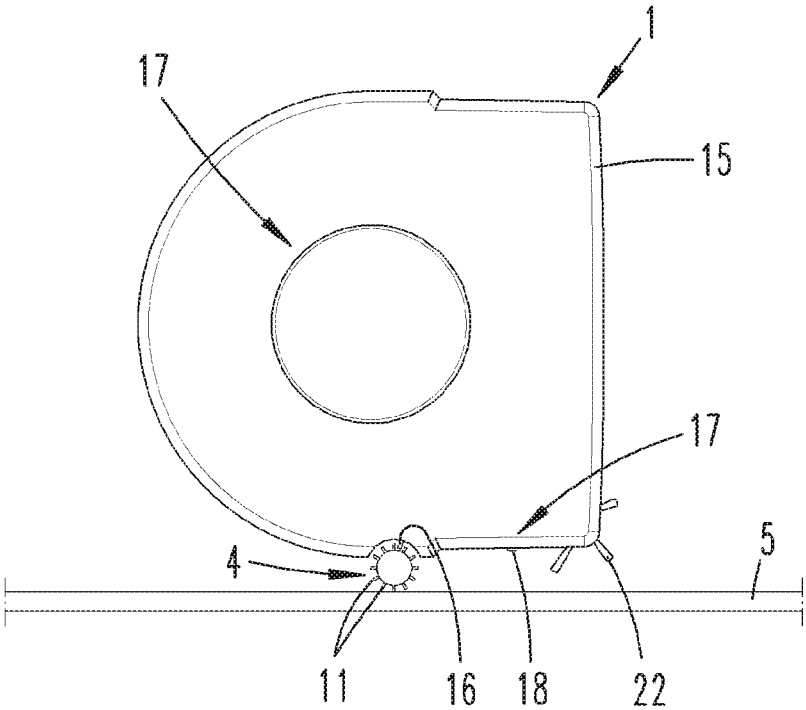
FIG. 11 is a top view of the cleaning device according to FIG. 10.

Finally, FIGS. 10 and 11 show two of many additional embodiments of a cleaning device 1 according to the invention, in which the above-floor cleaning element 4 designed as a comb 10 (FIG. 10) or as a roller 9 (FIG. 11) has allocated to it a regeneration element 16, which serves as a wiper for the bristles 11 of the above-floor cleaning element 4. In this embodiment, the above-floor cleaning element 4, which collected dust and dirt from the above-floor surface 5 and potentially also from a lateral surface 23 during an above-floor cleaning operation, can perform a regeneration, whether by the user at any point in time, or also automatically at prescribed points in time or time intervals. The above-floor cleaning element 4 is here shifted relative to the regeneration element 16, so that a mechanical interaction takes place between the above-floor cleaning element 4 and the regeneration element 16. The dust and dirt deposited on the bristles 11 of the above-floor cleaning element 4 is here wiped off on the regeneration element 16, and falls onto a surface 3, for example, which subsequently can again be cleaned by means of a surface cleaning system 2 of the cleaning device 1. Alternatively, it can also be provided that the dust and/or dirt fall directly into a corresponding collecting vessel or the like. It can preferably be provided that the above-floor cleaning element 4 come to engage directly with the regeneration element 16 while shifting back into the housing 15 of the cleaning device 1, so that a regeneration takes place after each use of the above-floor cleaning element 4.

The embodiments of the cleaning device 1 shown here are not conclusive, with subcombinations of the depicted embodiments also being conceivable.

The procedure described in particular relative to FIGS. 1 to 3 also applies accordingly for the other embodiments.

Although only a few embodiments of the present invention have been shown and described, it is to be understood that many changes and modifications may be made thereunto without departing from the spirit and scope of the invention.

LIST OF REFERENCES

1 Cleaning device
2 Surface cleaning system
3 Surface
4 Above-floor cleaning element
5 Above-floor surface
6 Rotational axis
7 Standing surface
8 Brush

9 Roller
10 Comb
11 Bristle
12 Filament
13 Fastening location
14 Free end area
15 Housing
16 Regeneration element
17 Detection system
18 Distance sensor
19 Distance sensor
20 Detection range
21 Detection range
22 Lateral brush
23 Lateral surface

What is claimed is:

1. A self-propelled cleaning device comprising:

a housing, a surface cleaning system for cleaning a surface to be cleaned, an above-floor cleaning element for mechanically cleaning an above-floor surface vertically offset relative to the surface to be cleaned, wherein the above-floor cleaning element is configured to be rotated or pivoted around a rotational axis, and at least one partial cleaning area of the above-floor cleaning element has a difference in height of at least 3 cm relative to a lowermost standing surface of the cleaning device when the cleaning device is conducting a cleaning operation, and a regeneration element in the form of a wiping lip, a brush or a comb arranged on the housing in such a way that the above-floor cleaning element brushes against the regeneration element while shifting relative to the housing.

2. The cleaning device according to claim 1, wherein the above-floor cleaning element has at least one of a brush, a roller and a comb.

3. The cleaning device according to claim 1, wherein the rotational axis is arranged essentially perpendicular to the standing surface of the cleaning device.

4. The cleaning device according to claim 1, wherein the above-floor cleaning element has bristles or filaments that each have a free end area pointing downwardly from their fastening location on the rotational axis in relation to a usual orientation of the cleaning device for a cleaning operation.

5. The cleaning device according to claim 1, wherein the above-floor cleaning element can be shifted toward the housing, into the housing, and/or out of the housing.

6. The cleaning device according to claim 1, wherein the above-floor cleaning element can be shifted relative to the housing while changing the height difference.

7. The cleaning device according to claim 1, further comprising a spring element allocated to the rotational axis, said spring element being arranged on the cleaning device and being designed in such a way that a restoring force of the spring element acts in a direction directed away from a housing of the cleaning device, or wherein the spring element is configured to be locked in a tensioned position through exposure to a force opposite the restoring force.

8. The cleaning device according to claim 1, further comprising a control system that controls a shifting and/or rotation of the above-floor cleaning element relative to the housing of the cleaning device as a function of a detection signal of a detection system, wherein the detection system is set up to detect an above-floor surface.

* * * * *